US006637162B1

(12) United States Patent
Holland

(10) Patent No.: US 6,637,162 B1
(45) Date of Patent: Oct. 28, 2003

(54) MODULAR PRECAST SPA SYSTEM

(76) Inventor: William F. Holland, 1012 SW. 51st Ter., Cape Coral, FL (US) 32914

( * ) Notice: Subject to any disclaimer, the term of this patent is extended or adjusted under 35 U.S.C. 154(b) by 0 days.

(21) Appl. No.: 10/026,409

(22) Filed: Dec. 19, 2001

(51) Int. Cl.[7] ..... E02D 27/00; E04H 4/00
(52) U.S. Cl. ..... 52/169.7; 4/506
(58) Field of Search ..... 52/169.7; 4/506

(56) References Cited

U.S. PATENT DOCUMENTS

| | | | | | |
|---|---|---|---|---|---|
| 3,031,801 | A | * | 5/1962 | Leuthesser | 249/DIG. 3 |
| 3,335,430 | A | | 8/1967 | Schwarz | |
| 3,555,575 | A | * | 1/1971 | Schwarz | 4/493 |
| 3,877,085 | A | * | 4/1975 | Bukaitz et al. | 4/488 |
| 4,023,217 | A | | 5/1977 | Kessler | |
| 4,142,337 | A | | 3/1979 | Holcomb | |
| 4,233,694 | A | | 11/1980 | Janosko | |
| 4,473,978 | A | | 10/1984 | Wood | |
| 4,843,658 | A | * | 7/1989 | Hodak | 4/506 |
| 4,948,296 | A | * | 8/1990 | Salter | 264/256 |
| 4,982,457 | A | | 1/1991 | Donaton | |
| 5,010,603 | A | * | 4/1991 | Hertzog | 4/488 |
| 5,325,644 | A | | 7/1994 | Cornelius | |
| 5,615,421 | A | | 4/1997 | Watkins | |
| 5,713,085 | A | * | 2/1998 | Enns | 4/506 |
| 5,727,264 | A | * | 3/1998 | Craig et al. | 4/489 |
| 5,953,767 | A | * | 9/1999 | Cloffey | 108/66 |
| 6,058,521 | A | * | 5/2000 | O'Brien | 4/492 |
| 6,170,094 | B1 | * | 1/2001 | Weise et al. | 239/17 |
| 6,226,938 | B1 | | 5/2001 | Hodak | |
| 6,357,059 | B1 | * | 3/2002 | Lau | 4/506 |

* cited by examiner

*Primary Examiner*—Carl D. Friedman
*Assistant Examiner*—Kevin McDermott
(74) *Attorney, Agent, or Firm*—Brian S. Steinberger; Law Offices of Brian S. Steinberger, P.A.

(57) ABSTRACT

Forms for building and assembling water containment holders such as but not limited to inground spas, pools, manmade ponds and fountains. The forms can have an L-shape with downwardly protruding members for allowing the forms to be placed about a base foundation having receiving openings for the protruding members. Lower walls, seats and backrests can be placed about the forms to assemble the water containment holder. All the components including the base, the forms, the seats, lower walls, and backrests can be modular components that are easily transported and assembled by an individual installer.

17 Claims, 5 Drawing Sheets

MODULAR PRECAST SPA SYSTEM

BACKGROUND AND PRIOR ART

Various methods and construction materials have been used to build pools and spas within the ground. A popular technique for building spas in the ground has required the use of a large elaborate steel type cage such as a large and heavy hexagon cage that is manufactured at remote locations and then transported as a whole piece to remote sites where the spa is to be installed. The large and heavy cages require trucks to be transported. At the installation site, installers assemble the spa by positioning pre-made sections about the cage. Finally, the areas around the cage are backfilled to complete the installation.

In addition to being heavy and difficult to transport, the cages can be damaged during the transportation process and have to be replaced. Also, the size of the cages requires more than worker to move them and more than one worker at the installation site which also adds extra labor expenses to the installation. The size and weight of the large and heavy hexagon cages are also difficult to maneuver at the installation sites, and can also become further damaged if moved at the site. Furthermore, since the metal cages are buried, the cages can be prone to rust and decompose unless rust resistant materials such as galvanized metal and/or coatings are used, which can add further expense and labor to the spa installation. Finally, any variation in the desired overall shape of the spa other than a hexagon shape requires an elaborate and expensive customization expense to the cost of installing the spa.

Various patents have been proposed over the years for assembling and building spas and pools. See for example, U.S. Pat. Nos. 3,335,430 to Schwarz et al.; 3,877,085 to Bukaitz et al.; 4,023,217 to Kessler; 4,142,337 to Holcomb; 4,233,694 to Janosko et al.; 4,473,978 to Wood; 4,982,457 to Donaton; 5,325,644 to Cornelius; 5,615,421 to Watkins et al.; and 6,226,938 to Hodak. However, none of the patents adequately overcomes the problems with assembling and installing spas as described above.

SUMMARY OF THE INVENTION

A primary objective of the invention is to provide a modular system for building and assembling water containment holders such as spas, pools, manmade ponds and fountains.

A secondary objective of the invention is to provide a method and components for building and assembling water containment holders such as spas, pools, manmade ponds and fountains, that does not require plural workers.

A third objective of the invention is to provide a method and components for building and assembling water containment holders such as spas, pools, manmade ponds and fountains, that is inexpensive and easy to assemble.

A fourth objective of the invention is to provide a method and components for building and assembling water containment holders such as spas, pools, manmade ponds and fountains, that does not require the transportation of large components that can be damaged during transport and installation.

A fifth objective of the invention is to provide a method and components for building and assembling water containment holders such as spas, pools, manmade ponds and fountains, that can be accomplished by a single installer.

A sixth objective of the invention is to provide a method and components for building and assembling water containment holders such as spas, pools, manmade ponds and fountains, without using large and heavy metal cages.

A seventh objective of the invention is to provide a method and components for building and installing water containment holders such as spas, pools, manmade ponds and fountains, that can be versatile to be used for building various shapes such as hexagons, rectangles, ovals, circles, triangles, and the like.

The preferred embodiment is described for using modular components such as novel L-shaped forms with additional modular components for building the water containment holders such as spas, pools, manmade ponds and fountains for both inground and above ground use.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1A:
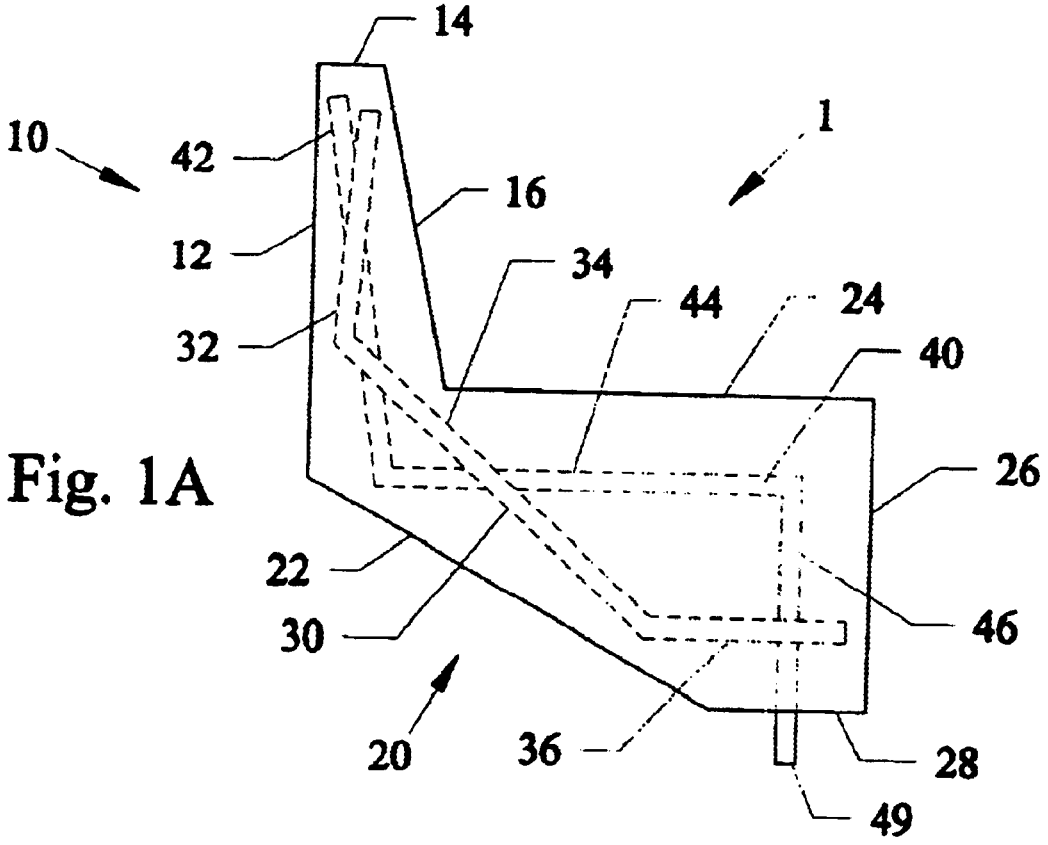
FIG. 1A shows a side view of a novel L-form used in constructing a spa.
Figure 1B:
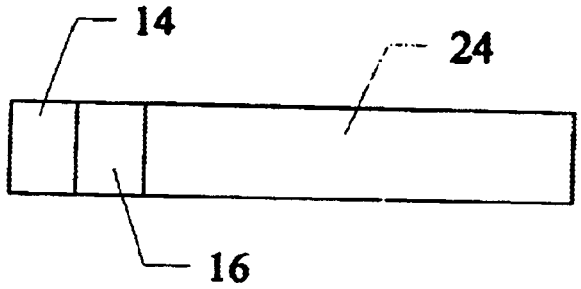
FIG. 1B shows a top view of the L-form of FIG. 1A along arrow A1.
Figure 1C:
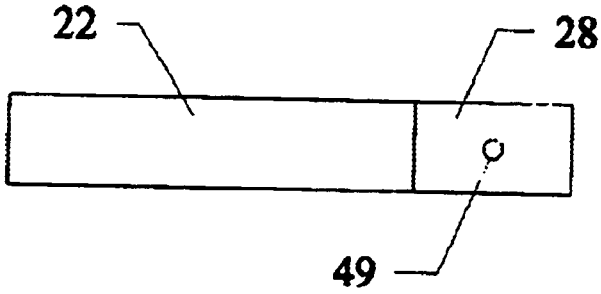
FIG. 1C shows a bottom view of the L-form of FIG. 1A along arrow A2.

FIG. 1A shows a side view of a novel L-form 1 used in constructing an inground water containment holder such as a spa, pool and manmade pond. FIG. 1B shows a top view of the L-form 1 of FIG. 1A along arrow A1. FIG. 1C shows a bottom view of the L-form 1 of FIG. 1A along arrow A2.

Referring to FIGS. 1A–1C, the L-shaped form 1 can include a vertical leg 10 having a substantially vertical planar back surface 12 having a height of approximately 17 inches, a flat horizontal top end 14 of approximately 3 inches, and a downwardly forward sloping front surface 16. Form 1 can include a horizontal leg 20 having an inclined rear back surface 22(having an incline of approximately 45 degrees) being approximately 16.75 inches long, a flat planar horizontal longitudinal top surface 24 being approximately 16.5 inches long, and a vertical planar front surface 26 approximately 12 inches in height, with a lower flat planar tip end 28 approximately 8 inches in length. L-form 1 can have a uniform width of approximately 3.5 inches, and can be entirely formed from a single pre-cast material such as concrete, and the like, and include reinforcement members 30, 40 therethrough, such as but not limited to rebar, and the like.

One reinforcement member 30 can have an upwardly slightly forward bending upper end portion 32 within the vertical leg 10, an angled mid portion 34 passing through the portion where vertical leg 10 and horizontal leg 20 meet, and a lower horizontal end portion above the flat tip lower end 28 of horizontal leg 20. A second reinforcement member 40 can have an upper end portion 42, and horizontal mid portion 44 and lower extending end portion 46 having a seat shape inside the L-form 1, which follows the contour of the forward sloping front surface 16 of vertical leg 10, flat planar horizontal longitudinal top surface 24, and vertical planar front surface 26 of horizontal leg 20. Extending beneath lower flat tip end 28 of the horizontal leg 20 can be a downwardly protruding portion 49 of the reinforcement member 40. Alternatively, the L-shaped form can be premolded and shaped with a protruding portion 49 extending downward from the form without having to use any interior reinforcement members, and further sealing material and bonding materials can be used during the assembly which is described later.

Figure 2:
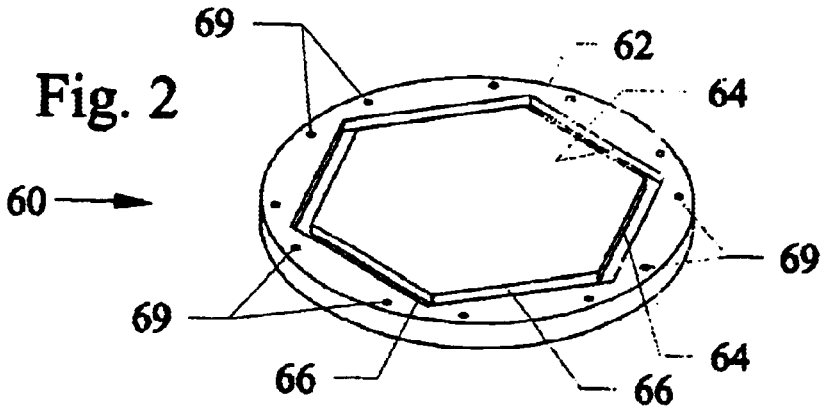
FIG. 2 shows the initial assembly step of providing a foundation base for the spa.

FIG. 2 shows the initial assembly step of providing a foundation base 60 for the water containment holder. Foundation base 60 can be disc shaped and be formed from a pre-cast material similar to that of L-form 1 previously described. Foundation base 60 can have a circular exterior surface 62 and an interior cutout pattern 64 that can be shaped like a hexagon. While the circular exterior shape and the hexagon interior shape is shown, both the exterior shape and the interior shape can have different configurations, such as but not limited to circular, oval, rectangular, square, triangular, polygon and the like. Inside the interior hexagon cutout pattern 64 of base 60 can be a lower ledge edge 66. Arranged about the perimeter of the upper surface of the base 60 can be openings 69 whose relevance will be described later. The foundation base 60 can be positioned over a selected surface where the water containment holder is to be installed such as but not limited to against a ground surface.

Figure 3:
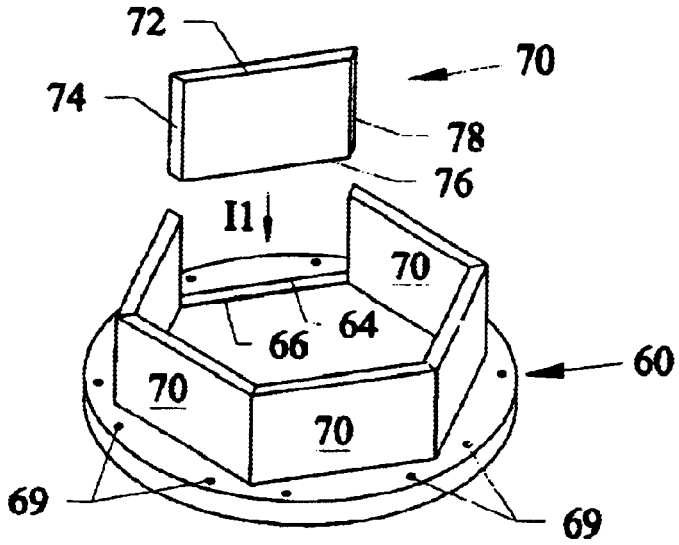
FIG. 3 shows a second step of installing the lower wall sections on the base of FIG. 2.

FIG. 3 shows a second step of installing lower wall sections 70 onto the base 60 of FIG. 2. Each lower wall section 70 can be formed form a pre-cast material similar to the L-forms 1 and base 60 previously described. Lower wall section 70 can be rectangular shapes having a lower side 76 which can be positioned in the direction of arrow I1 onto each ledge surface 64 inside the base 60, and have inwardly angled sides 74, 78 for allowing each wall section 70 to be placed close against one another one after the other.

Figure 4:
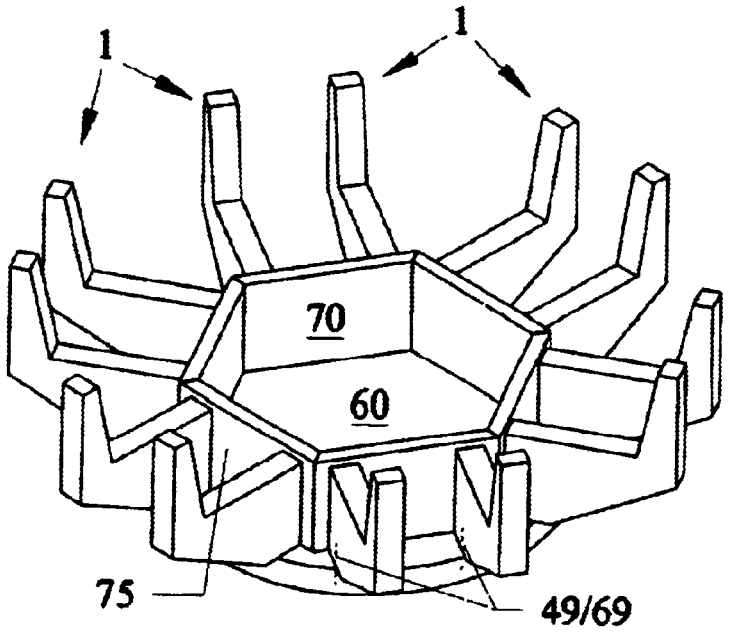
FIG. 4 shows a third step of installing the L-forms of FIGS. 1A–1C on the base of FIG. 3.

FIG. 4 shows a third step of installing the L-forms 1 of FIGS. 1A–1C on the base 60 of FIG. 3. One after another each of the L-forms 1 can be placed about the base 60 by inserting the downwardly protruding portion 49 of the reinforcement members 40 in each L-form 1 (shown more clearly in FIG. 1) into the openings 69 about the upper surface perimeter of the base 60. As shown in FIG. 2, there are twelve openings 60 shown in the base 60 and in FIG. 4, there are twelve L-shaped forms 1 that are held in place by these openings 69 which support the L-shaped forms 1. Referring to FIGS. 1 and 4, when the L-forms 1 are in place, each vertical planar front surface 26 of each horizontal leg 20 of the L-forms abuts against the exterior surface 75 of each wall section 70.

Figure 5:
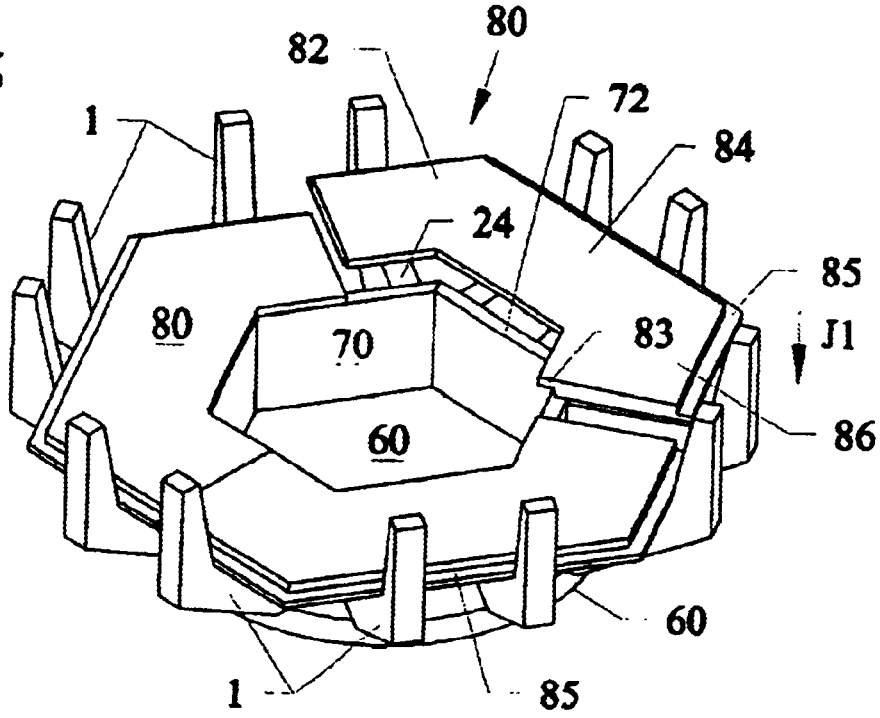
FIG. 5 shows a fourth step of installing the seat sections onto the L-forms in FIG. 4.

FIG. 5 shows a fourth step of installing the seat sections 80 onto the L-forms 1 in FIG. 4. Each seat section 80 can be formed from a pre-cast material such as those previously described. The seat sections can have a C-type shape having upper and lower angled leg sections 82, 86 about a mid-leg section 84. The interior facing portion of the seats 80 can include an overhang portion 83 which is sized to fit over the upper side 72 of each lower wall 70, and the outside edge of each seat 80 can include an indented ledge portion 85 whose relevance will be explained later. Each seat 80 can be placed top of the horizontal planar surface 24 of the horizontal leg 20 of each form 1 in the direction of arrow J1 one after another until all the seats 80 are positioned in place. In FIG. 5, three seat portions 80 are shown but more or less seat sections can be used as needed.

Figure 6:
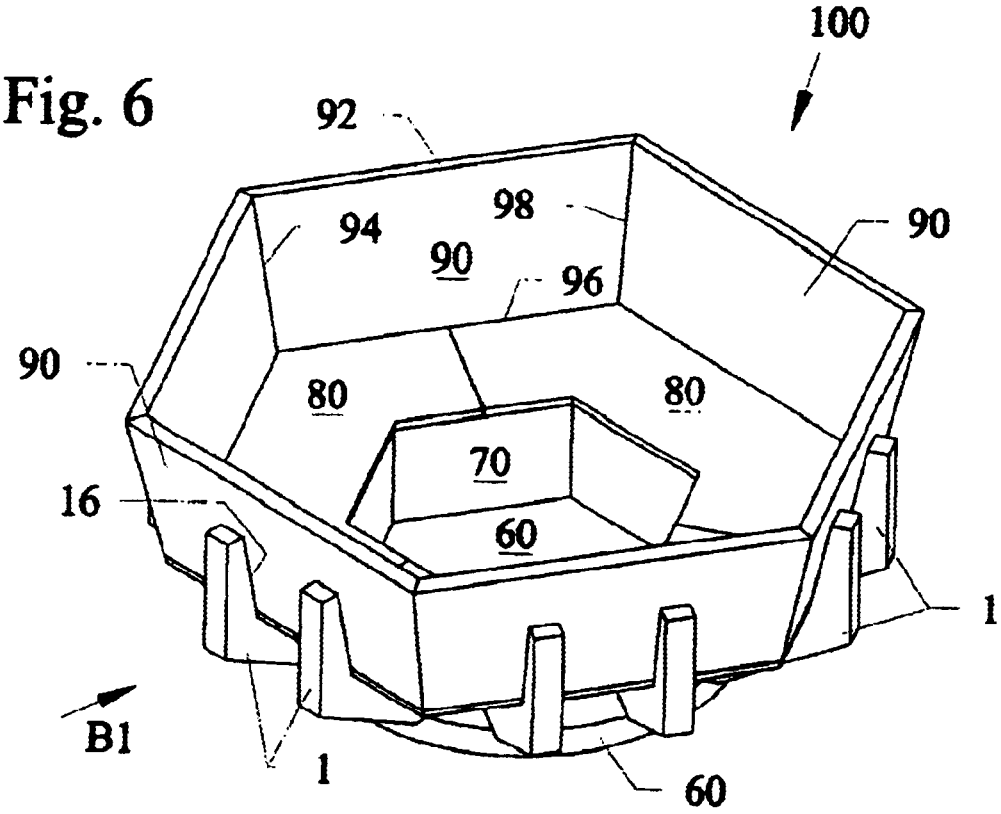
FIG. 6 shows a fifth step of installing the backrest sections with the L-forms of FIG. 5.

FIG. 6 shows a fifth step of installing the backrest sections 90 with the L-forms 1 of FIG. 5. Each backrest section 90 can be formed from a pre-cast material previously described. Each backrest section 90 can be an enlarged version of the lower wall sections 70 and can include rectangular shapes having a lower side 96 which can be positioned onto each ledge surface 85 of seat section 80(shown in FIG. 5) and leaned against forward sloping front surface 16 of each L-form 1. Each backrest section 90 can have inwardly angled sides 94, 98 for allowing each wall section 90 to be placed close against one another, one after the other, similar to the placement of lower wall sections 70.

Figure 7:
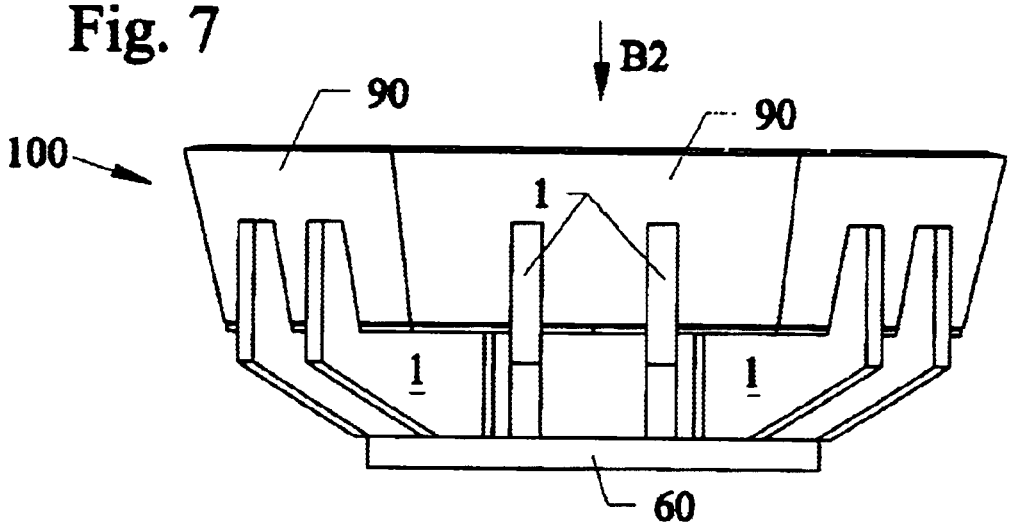
FIG. 7 is a side view of the assembled spa of FIG. 6 along arrow B1.
Figure 8:
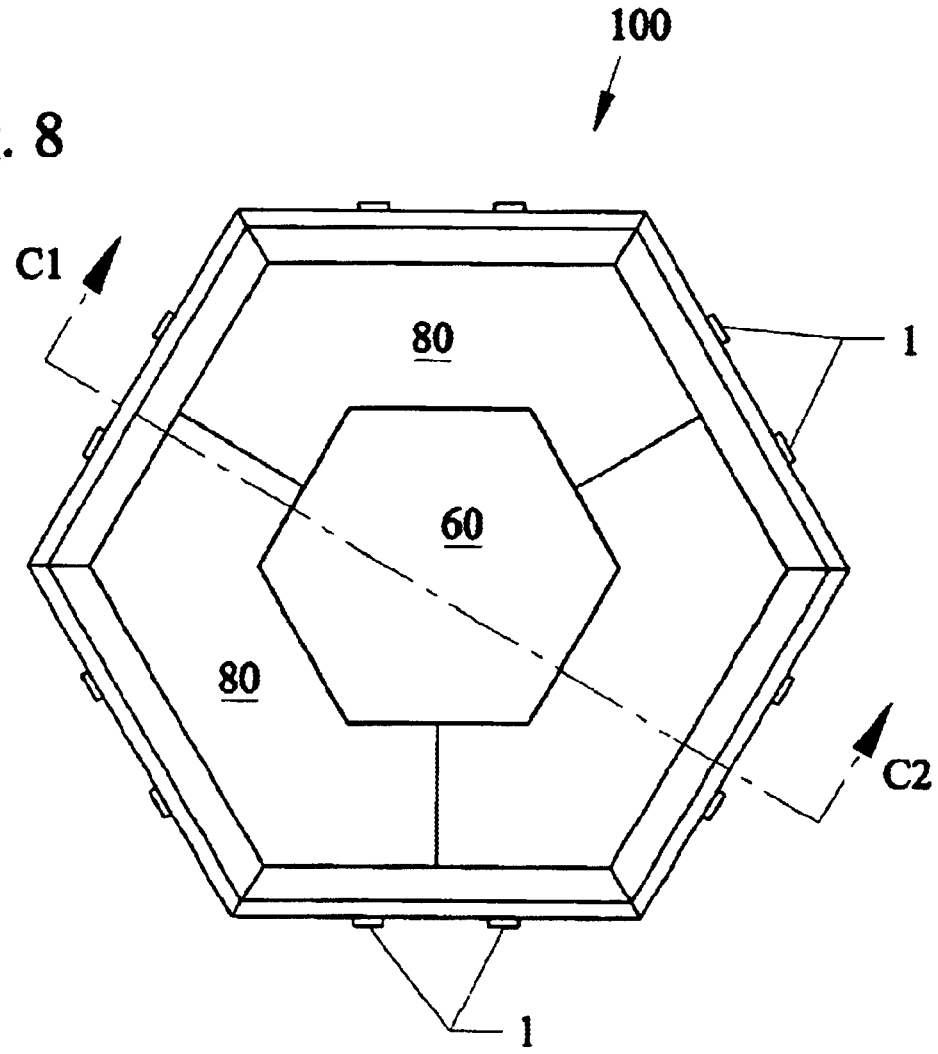
FIG. 8 is a top view of the assembled spa of FIG. 7 along arrow B2.
Figure 9:
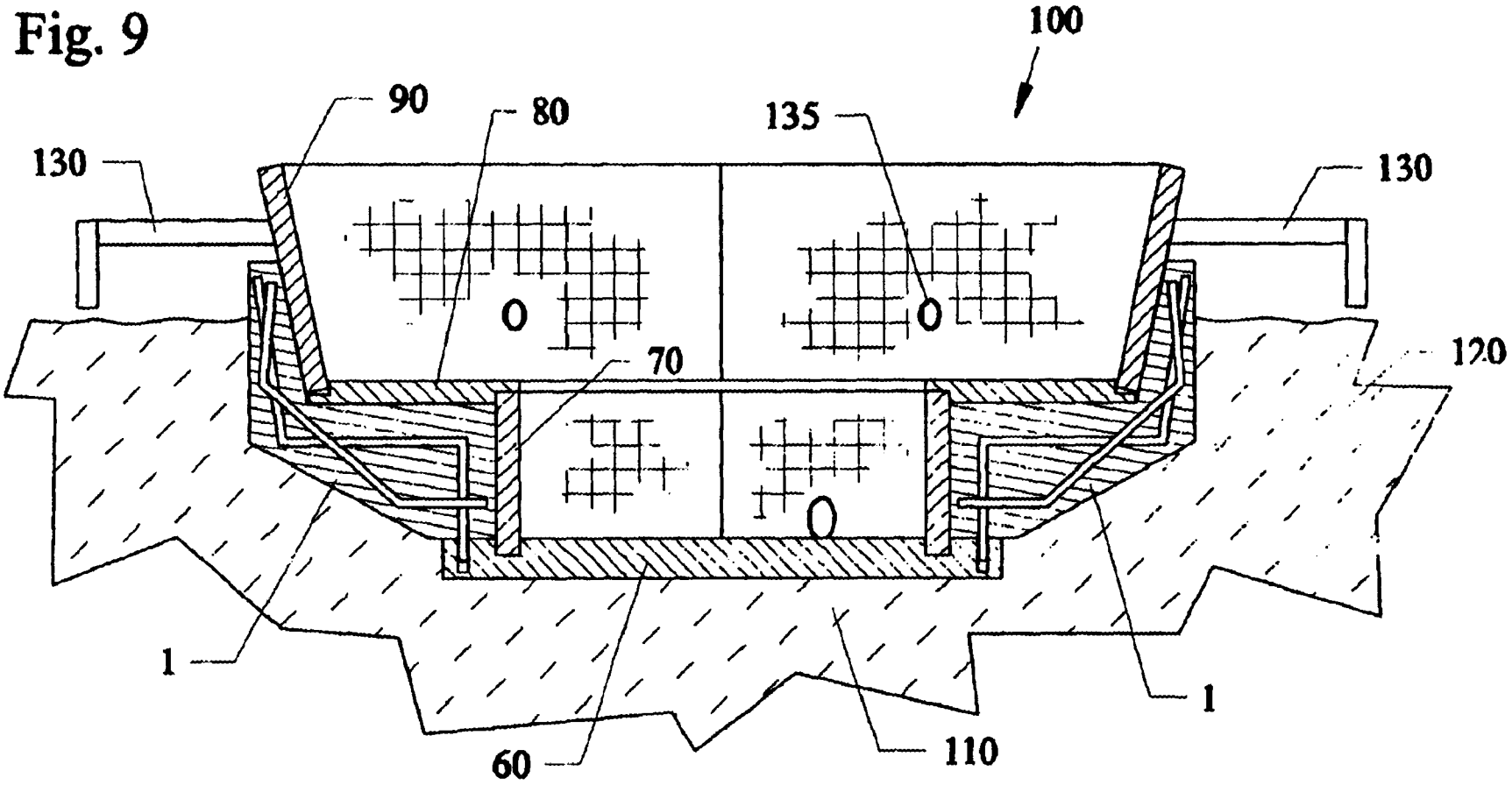
FIG. 9 is a cross-sectional view of the assembled spa of FIG. 8 along arrows C1 with backfill around the spa.

FIG. 7 is a side view of the assembled water containment holder 100 of FIG. 6 along arrow B1. FIG. 8 is a top view of the assembled water containment holder 100 of FIG. 7 along arrow B2. FIG. 9 is a cross-sectional view of the assembled water containment holder 100 of FIG. 8 along arrows C1 with backfill 120 filled in around the water containment holder 100. As shown in FIG. 9, base 60 can be initially placed on a ground surface 110 after which the water containment holder 100 such as the spa is assembled followed by the backfill 120. In the final assembly, water lines 130 can connect to side ports 135 in the spa 100.

Additionally, all joints where any component meets another component can be separately caulked and/or grouted and/or sealed as needed to form a final waterproof seal and bond between the components. Finally, the spa 100 can be ready to be filled with water and used.

Although the preferred embodiment describes using the novel invention to build inground water containment holders, the invention can be used for above ground applications. Furthermore, the water containment holders can be used in other applications such as but not limited to a novel constructed spa being assembled in a pre-existing pool, and the like.

While the preferred embodiment shows building a hexagon shaped spa, the invention can be versatile to build any other shapes, such as but not limited to oval, circular, triangular, rectangular, square, polygon, and the like.

Although the preferred embodiment describes the invention for building spas, the invention methods and components can be used to build other water filled cavities such as but not limited to pools, manmade ponds, and fountains. For example, the Figures can also be described for building these other water containment holders.

Although concrete type pre-cast material has been described, the invention can be practiced with modular components using any natural or manmade materials that can be formed and/or molded, such as but not limited to rocks, wood, plastic, fiberglass, foam, and the like, and composites, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A method of assembling water containment holders, comprising the steps of:

providing pre-cast L-shaped forms, each having a vertical leg and a horizontal leg;

providing a base member having a substantially flat planar surface with a cut-out interior pattern as a foundation, the pattern having ledge edges;

positioning wall sections on the ledge edges within the cut-out interior pattern of the base member, the wall section having outer surfaces; and attaching the horizontal leg of the L-shaped forms to the planar surface of the base member where an end portion of each horizontal leg abuts against the outer surfaces of the wall sections;

wherein the base member, the wall sections, and forms constitute a water containment holder.

2. The method of claim 1, wherein the step of attaching the L-shaped forms includes the step of:

inserting portions of the L-shaped forms into the base member.

3. The method of claim 1, wherein the step of assembling further includes the steps of:

providing seat panels and backrest panels and water;

placing the seat panels an the backrest panels on the L-shaped forms.

4. The method of claim 1, wherein the step of assembling includes the step of: assembling a spa.

5. The method of claim 1, wherein the step of assembling includes the step of: assembling a pool.

6. The method of claim 1, wherein the step of assembling includes the step of: assembling a pond.

7. The method of claim 1, further comprising the step of:

placing the water containment holder inground.

8. The method of claim 1, further comprising the step of:

backfilling about the water containment holder.

9. The method of claim 1, wherein the positioning of the wall sections step includes the step of: placing the wall sections side by side to one another.

10. The method of claim 3, wherein the step of placing the seat panels and the backrest panels includes the step of:

overhanging front portions of the seat panels on top of the wall sections; and positioning the backrest panels onto the seat panels.

11. The method of claim 1, wherein the step of providing the L-shaped forms includes the step of: pre-casting each of the L-shaped forms.

12. A method of assembling a spa comprising the steps of:

providing a base member with a surface area having openings, and interior facing ledges about a cut-out pattern;

providing L-shaped forms with bottom protruding tip portions;

inserting the bottom protruding tip portions of the L-shaped forms into the surface openings on the surface portion of the base member;

placing wall portions on the interior facing ledge edges along the cut-out pattern in the base member; and positioning seats on the L-shaped forms.

13. The method of claim 12, the step of positioning the seats includes the steps of:

providing separate seat panels and backrest panels;

placing the separate seat panels and the backrest panels on the L-shaped forms.

14. The method of claim 13, wherein the step of placing the separate seat panels and the backrest panels includes the steps of:

overhanging portions of the seat panels on top of the wall portions; and positioning the backrest panels into indented rear edge portions of the seat panels.

15. The method of claim 12, wherein the step of providing the L-shaped forms includes the step of: pre-casting each of the L-shaped forms.

16. The method of claim 12, wherein the step of forming a watertight spa includes the step of:

providing joints in the watertight spa;

forming the watertight spa by sealing the joints that would be exposed to water in the spa.

17. The method of claim 1, wherein the step of assembling the water containment holder includes the step of:

providing joints in the water containment holder;

forming the water containment holder by sealing the joints that would be exposed to water in the water containment holder.

* * * * *